United States Patent [19]

Geyer

[11] 4,426,934

[45] Jan. 24, 1984

[54] FRICTION CASTING BOLSTER POCKET WEAR PLATE HAVING A PLURALITY OF SIDES

[75] Inventor: Robert P. Geyer, Palatine, Ill.

[73] Assignee: Standard Car Truck Company, Chicago, Ill.

[21] Appl. No.: 340,897

[22] Filed: Jan. 20, 1982

[51] Int. Cl.[3] ..... B61F 5/12

[52] U.S. Cl. ..... 105/197 DB; 188/136

[58] Field of Search ..... 105/197 DB, 197 D; 188/233.3, 136

[56] References Cited

U.S. PATENT DOCUMENTS

| | | | |
|---|---|---|---|
| 2,375,919 | 5/1945 | Haseltine | 105/197 D |
| 2,974,758 | 3/1961 | Ekholm | 188/233.3 |
| 3,654,871 | 4/1972 | Wallace | 105/197 DB |
| 3,712,247 | 1/1973 | Young | 105/197 DB |
| 3,851,595 | 12/1974 | Clasen | 105/197 DB |

*Primary Examiner*—Robert B. Reeves
*Assistant Examiner*—David F. Hubbuch
*Attorney, Agent, or Firm*—Kinzer, Plyer, Dorn & McEachran

[57] ABSTRACT

A railroad car truck bolster has a plurality of pockets each of which will position a friction wedge for use in damping motion between the bolster and the side frame. Each pocket has a slanted rear wall and adjoining side walls perpendicular thereto, the side walls being generally perpendicular to the longitudinal axis of the bolster. One of the side walls is designated the inboard side wall and the other is designated the outboard side wall. The present invention is specifically concerned with a wear plate which is positioned within the friction wedge pocket and has a main portion formed and adapted to substantially conform to the pocket slanted wall and at least one wall portion integral therewith and formed and adapted to substantially conform to the pocket outboard side wall, an area subject to substantially greater wear than the inboard pocket side wall. Further, there are elements on the wear plate for cooperative attachment of the wear plate to the pocket.

3 Claims, 6 Drawing Figures

10
24
18a
18
25
2
16
23
2
12
21
22
26
14
20
20a
21

18a
30
18
24
25
3
10
23
20
3
24
21
22
6
21
6
30
20a
16
26a 26
23
21
23
21
22
24a
26a
24
26

23
21
26a
-22-
24a
26
24

FRICTION CASTING BOLSTER POCKET WEAR PLATE HAVING A PLURALITY OF SIDES

SUMMARY OF THE INVENTION

The present invention relates to wear plates for the friction wedge pocket of railroad car truck bolsters and in particular to a wear plate which will protect the outboard pocket side wall.

Another purpose is a wear plate of the type described which is symmetrical and cannot be improperly installed in a friction wedge bolster pocket.

Another purpose is a wear plate of the type described which is generally U-shaped in cross section and has side wall portions to protect both the inboard and outboard walls of the friction wedge bolster pocket.

Another purpose is a wear plate of the type described which includes cooperating means thereon for use in attaching the wear plate to the bolster pocket.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figures 1, 2, 3, 4, 5, 6:
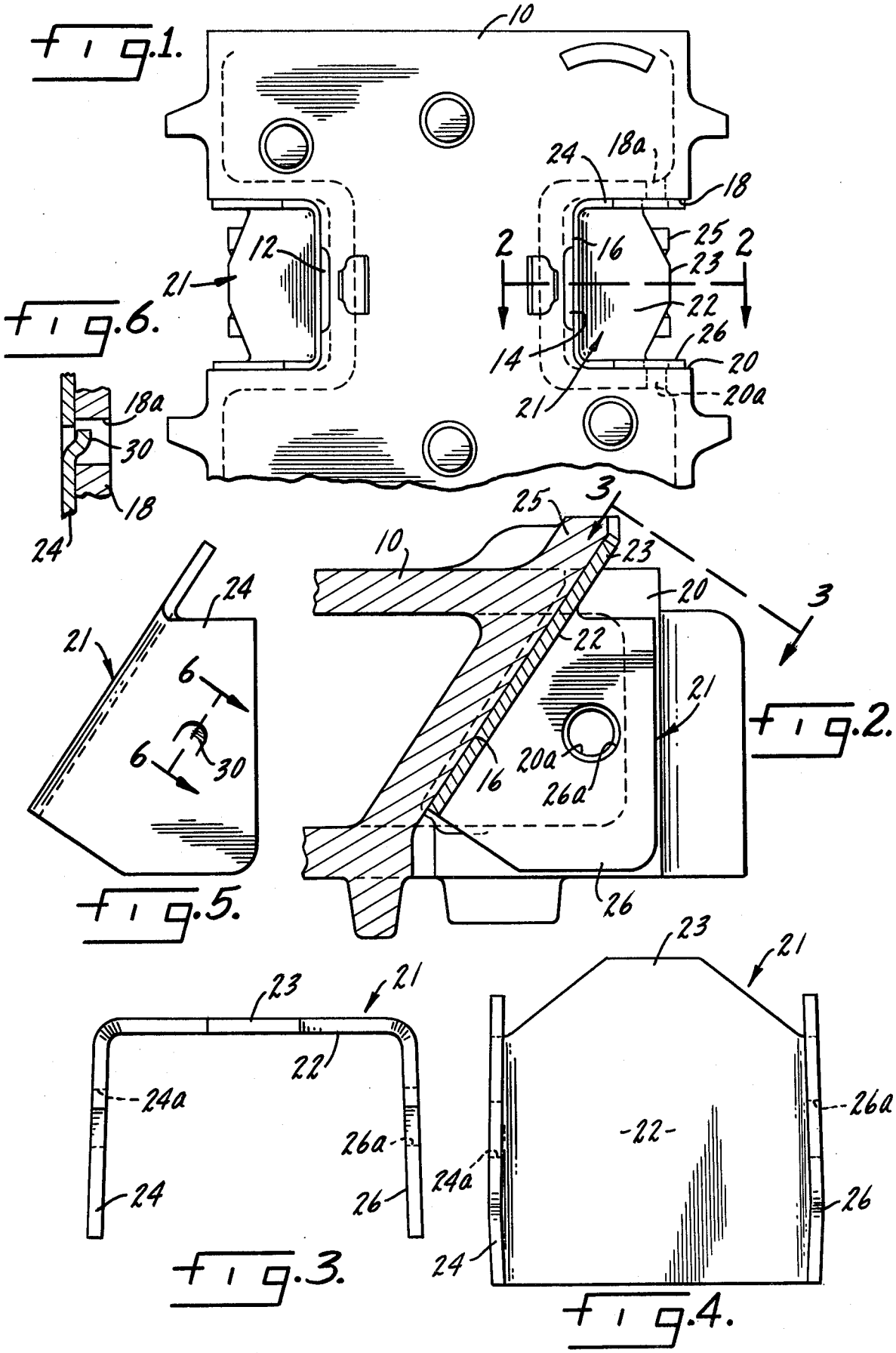
FIG. 1 is a bottom plan view of a portion of a railroad car truck bolster.
FIG. 2 is an enlarged section along plane 2—2 of FIG. 1.
FIG. 3 is a top plan view along plane 3—3 of FIG. 2.
FIG. 4 is a plan view of the wear plate disclosed herein.
FIG. 5 is a side view of a modified form of wear plate.
FIG. 6 is a partial section along plane 6—6 of FIG. 5 illustrating the attachment of the wear plate of FIG. 5 to the bolster pocket.

It has long been conventional in railroad car trucks to position a friction wedge in a bolster pocket to dampen movement between the bolster and the side frame. To prevent wear to the bolster pocket, which is conventionally formed of a soft steel casting, it has long been conventional to position a hardened steel wear plate along the slanted wall of the bolster pocket. A wear plate is also positioned along the vertical surface of the side frame, with the dampening wedge being positioned between and bearing against these two wear plates. Thus, the wear plates prevent wear on both the bolster and the side frame.

It has been noted, particularly in high mileage, high utilization railroad cars, such as those on unit coal trains, that there is substantial degree of wear on the bolster pocket outboard side wall and heretofore there has been no wear plate protecting this surface from damaging wear by the friction wedge. Such wear on the outboard wall of the bolster pocket may be due to the phenomenon known in the art as hunting or to the rock and roll action of a freight car on rough track wherein the bolster may move laterally relative to the side frames, causing a wear and impact-type of reaction between the bolster pocket and the friction wedge positioned therein. The actual cause of the wear has not been totally defined, but the presence of the wear is becoming an increasing problem with cars of the type described. The present invention is specifically directed to a wear plate which not only protects the slanted wall of the bolster friction wedge pocket, but also protects the outboard wall of the friction wedge pocket, e.g. the wall that has been the subject of the wear described above.

Although in some applications the wear plate disclosed herein may have an L-shaped configuration, it appears to be more practical from both a marketing and installation point of view to provide a U-shaped wear plate, that is, one in which there are side walls positioned to absorb the wear of the bolster friction wedge at both the inboard and the outboard sides of the friction wedge pocket. This removes any complications in installation, as the wear plate cannot be incorrectly installed. Also, it removes the difficulties in inventorying both right and left-hand wear plates which would be necessary if L-shaped wear plates were to be utilized. Nevertheless, in some applications and for some specific type cars an L-shaped wear plate may be practical.

Wear plates of the type generally described above as being utilized in the prior art are shown in U.S. Pat. No. 3,851,595, assigned to the assignee of the present application. The abovementioned patent illustrates the railroad car truck side frame, the springs supporting the bolster within the side frame window and the friction wedge and its supportive spring. In the present application only the bolster and the wear plate are shown and it should be understood that conventionally the bolster will extend through a window in the side frame and there will be friction wedges positioned in the bolster friction wedge pockets.

In FIG. 1 one end of a bolster is indicated at 10 and there are friction wedge pockets 12 and 14 on opposite sides of the bolster. As is well known in the art, each end of the bolster will be similarly constructed and there are normally two such friction wedge pockets at each end of the bolster with the friction wedges being generally located in register with the side frame. Pockets 12 and 14 are identically constructed and only one will be described in detail. Pocket 14 has a rear slanted wall 16 and adjoining side walls 18 and 20 with side wall 18 being designated the outboard side wall and wall 20 being designated the inboard side wall. Walls 18 and 20 will each have holes **18*a* and 20*a***, respectively, which holes will conventionally receive a cotter pin or the like which will extend through the holes and through a mating opening in the friction wedge to thereby mount or position the friction wedge within the bolster pocket. Again, the friction wedge is not shown herein, but a wedge such as shown in the above-mentioned '595 patent is typical.

Referring specifically to the wear plate construction illustrated in FIGS. 1-4, plate 21 has a main portion 22 which will substantially conform in size and shape to the slanted rear wall 16 of the bolster pocket, particularly as illustrated in FIG. 2. The upper edge of portion 22 has a center upward wedgeshaped extension 23 to protect an upward extension 25 of the bolster pocket. Integral with the main portion 22 of the wear plate are side wall portions 24 and 26. Preferably the wear plate will be made of a single metal plate with the wall portions being suitably formed in the manufacturing process. When positioned within the bolster pocket the wall portions 24 and 26 will substantially conform to the outboard and inboard walls of the bolster pocket, thus providing the desired and necessary protection against wear, particularly to the bolster pocket outboard wall, but also to the bolster pocket inboard wall.

There are various methods of attaching the wear plate to the bolster pocket. One method is to use the welding lugs and welds such as shown in U.S. Pat. No. 3,851,595. Another satisfactory method of attaching the wear plate to the bolster pocket is to provide the wear plate side walls with openings 24*a* and 26*a*, respectively, which are in register with openings 18*a* and 20*a* on the bolster pocket side walls. Thus, there may be welds applied at the openings 24*a* and 26*a* to thereby physically attach the wear plate to the bolster pocket. Such welds will not in any way interfere with the conventional cotter pin which is used to mount the friction wedge within the pocket.

An alternative method of attaching the wear plate 21 to the bolster pocket is to provide outwardly extending tangs or projections 30, such as illustrated in FIG. 5, on each side of the wear plate side walls 24 and 26. Such tangs or projections 30, as particularly illustrated in FIG. 6, will be formed and positioned to extend into openings 18*a* and 20*a* on the bolster pocket side walls. The construction of FIGS. 5 and 6 has an advantage in that welds are not required to attach the wear plate to the bolster pocket and the construction can be appropriately characterized as a snap-in arrangement. In like manner, there may be dimples or some other form of projection which may be used to snap in the wear plate to the bolster pocket.

A further method of attaching the wear plate would utilize side wall projections which extend down into the spring seat area. Such a construction would entail a recess in the spring seat area.

Whereas the preferred form of the invention has been shown and described herein, it should be realized that there may be many modifications, substitutions and alterations thereto.

The embodiments of the invention in which an exclusive property or privilege is claimed are defined as follows:

1. A wear plate for the friction wedge pocket of a railroad car truck bolster, the pocket having a slanted rear wall and adjoining side walls perpendicular thereto, the side walls being generally perpendicular to the longitudinal axis of the bolster, with one of the side walls being the inboard side wall and the other being the outboard side wall, said wear plate including a main portion formed and adapted to substantially conform to the pocket slanted wall and a pair of wall portions, each integral with and perpendicular to said wear plate main portion, one of said wall portions being formed and adapted to substantially conform to the pocket outboard side wall and the other wall portion being formed and adapted to substantially conform to the pocket inboard side wall, and means on said wear plate for cooperative attachment to the pocket.

2. The wear plate of claim 1 further characterized in that said means on the wear plate for cooperative attachment to the pocket includes an opening in the wear plate wall portion permitting the use of a weld therein to attach the wear plate to the pocket.

3. The wear plate of claim 1 further characterized in that the means for cooperative attachment to the pocket includes an outwardly extending projection exterior of said wear plate wall portion which cooperates with a mating opening in the pocket side wall.

* * * * *